US005938799A

United States Patent [19]

Spencer et al.

[11] Patent Number: 5,938,799

[45] **Date of Patent: *Aug. 17, 1999**

[54] EMERGENCY FUEL FOR USE IN AN INTERNAL COMBUSTION ENGINE

[75] Inventors: Reginald N. Spencer, Baltimore; William A. Hubbard, Timonium, both of Md.

[73] Assignee: Maryland Patent Holdings, LLC, Towson, Md.; a part interest

[ * ] Notice: This patent is subject to a terminal disclaimer.

[21] Appl. No.: 09/082,407

[22] Filed: May 20, 1998

Related U.S. Application Data

[63] Continuation-in-part of application No. 08/956,222, Oct. 22, 1997, Pat. No. 5,853,433, which is a continuation-in-part of application No. 08/604,080, Feb. 20, 1996, Pat. No. 5,681,358, which is a continuation-in-part of application No. 08/536,366, Sep. 29, 1995, abandoned.

[51] Int. Cl.[6] ..... C10L 1/04; C10L 1/14

[52] U.S. Cl. ..... 44/300; 585/14

[58] Field of Search ..... 44/300, 451; 585/14

[56] References Cited

U.S. PATENT DOCUMENTS

| | | | |
|---|---|---|---|
| 1,204,638 | 11/1916 | Axtell | 44/452 |
| 4,357,146 | 11/1982 | Heeren | 44/452 |
| 4,539,014 | 9/1985 | Sweeney | 44/452 |
| 5,681,358 | 10/1997 | Spencer et al. | 44/300 |

*Primary Examiner*—Jacqueline V. Howard
*Attorney, Agent, or Firm*—Leonard Bloom

[57] ABSTRACT

An emergency fuel for internal combustion engines is stable for storage for a year or more. The emergency fuel is stored in a container which has an outlet sealed with a removable seal. The container is prevented from being reused for storage after the seal is removed. The fuel is a mixture of two fractions of refined mineral spirits, one fraction being 58–50% by weight and having 0% aromatics, the other fraction being 42–50% by weight and having 100% aromatics. A biocide is added to the mineral spirits.

7 Claims, 10 Drawing Sheets

EMERGENCY FUEL FOR USE IN AN INTERNAL COMBUSTION ENGINE

CROSS REFERENCE TO RELATED APPLICATIONS

The present application is a continuation-in-part of application Ser. No. 08/956,222, filed Oct. 22, 1997 now U.S. Pat. No. 5,853,433, which is a continuation-in-part of application Ser. No. 08/604,080, filed Feb. 20, 1996 now U.S. Pat. No. 5,681,358, which is a continuation-in-part of application Ser. No. 08/536,366, filed Sep. 29, 1995, abandoned, the disclosure of which are incorporated in their entirety by reference herein.

BACKGROUND OF THE INVENTION

This invention is an emergency gasoline motor fuel which can be safely stored for long periods in a conveyance for use in the emergency situation when the regular fuel supply is depleted. It also covers the means of storing said fuel in a container having specific features.

The problem of "running out of gas" is as old as the use of gasoline in powering vehicles such as automobiles and boats. It has been a long-existing problem and here-to-fore no one has come up with a safe and practical answer. The reason this problem has defied solution is that gasoline normally contains some butane and pentane giving the gasoline a flash point of minus 40° to minus 50° F. The butane and pentane are necessary so that a cold motor can be readily started. This means that any spill of gasoline will quickly vaporize to form potentially explosive fumes which can be ignited by a spark or flame. As a result, it is extremely dangerous to store or transport gasoline in a container in a car or other conveyance. Indeed, many states have laws making it illegal to store a container of gasoline in the trunk of an automobile. This emergency fuel however, contains no butane or pentane and, therefore, can be safely stored in an automobile or other conveyance. It is also stable and will not degrade over long periods of storage of a year or more.

Most of the prior art of which the applicants are aware have been directed to improving the combustibility of gasoline for quicker starts and faster acceleration, enabling a fuel to be used at lower temperatures, and improving the octane rating. This has been accomplished by addition of alcohols, ketones and ethers to gasoline and petroleum fuel products. The following patents are directed to these goals:

| Inventor(s) | U.S. Pat. No. |
|---|---|
| Dinsmore | 1,331,054 |
| Hayes | 1,361,153 |
| Van Schaack, Jr. | 1,907,309 |
| Savage | 2,088,000 |
| Savage | 2,106,661 |
| Savage | 2,106,662 |
| Schneider et al | 2,176,747 |
| Hori et al | 3,697,240 |

These references are not for use of a substitute fuel for internal combustion engines which is safe for storage in a vehicle.

The only prior art for an emergency fuel of which the applicants are aware is a product that was temporarily marketed by Cristy Corporation, Fitchburg, Mass. under the name "RESCUE®" in the 1970s. The product was later offered by Snap Products, Durham, N.C. The product is no longer marketed and apparently was not commercially viable because it was difficult to start an engine using the product and the exhaust was smoky and had an offensive odor. Furthermore, the container in which "RESCUE®" was marketed did not have a spout but required the use of an auxiliary funnel to pour the product into a gas tank.

Thus, there is a need for an emergency fuel which is safe, operates efficiently in an internal combustion engine and which is in a container which can be used without additional components.

BRIEF SUMMARY OF THE INVENTION

Accordingly, objects of the present invention are:

a. An emergency fuel that can be safely stored in most conveyances.

b. An emergency fuel with a flash point at or above 5° F. Even at the 5° F. flash point, the fuel is significantly safer than gasoline. Increasing the flash point above 5° F. makes the fuel even safer. At the same time, work with test motors indicates that the use of a higher flash point makes starting motors more difficult.

c. An emergency fuel that can be added to the tank of a vehicle that has "run out of gas" and enables the vehicle to start even if its motor is cold.

d. An emergency fuel that will run smoothly in most internal combustion engines.

e. A container for the emergency fuel having a neck or extendable spout to reach down into the automobile gas tank inlet and press open the metal shield so that said fuel can be poured into said fuel tank. The neck or spout must be small enough in diameter to fit into the lead-free gas tank inlet.

f. Means for closing the container mentioned above with a closure that is rendered useless when said closure is opened. This makes it impossible for the user to empty said container and refill it with gasoline for storage in the conveyance.

g. An emergency fuel that may contain one or more oxygen-containing solvents which, in combination with residual gasoline in the fuel system, exert enough solvency action to dissolve and remove the gum deposits in the tank and fuel system resulting from the extended use of ordinary gasoline.

h. An emergency fuel that is stable in storage for a period of a year or more.

In accordance with the teachings of the present invention, there is disclosed an emergency fuel for an internal combustion engine to be stored in a vehicle to be used when the vehicle is out of fuel. The emergency fuel includes mineral spirits and a biocide in the range of 175–500 ppm to ensure stable storage. The emergency fuel has an octane number of at least 90.

The emergency fuel is a mixture of approximately 58–50% by weight of a first fraction of mineral spirits having 0% aromatic content and approximately 42–50% by weight of a second fraction of mineral spirits having 100% aromatic content.

Still other objects of the present invention will become readily apparent to those skilled in this art from the following description, wherein there is shown and described a preferred embodiment of this invention. Simply by way of illustration, the invention will be set forth in part in the description that follows and in part will become apparent to those skilled in the art upon examination of the following or may be learned with the practice of the invention. Accordingly, the drawings and descriptions will be regarded as illustrative in nature and not as restrictive.

DESCRIPTION

Figure 1:
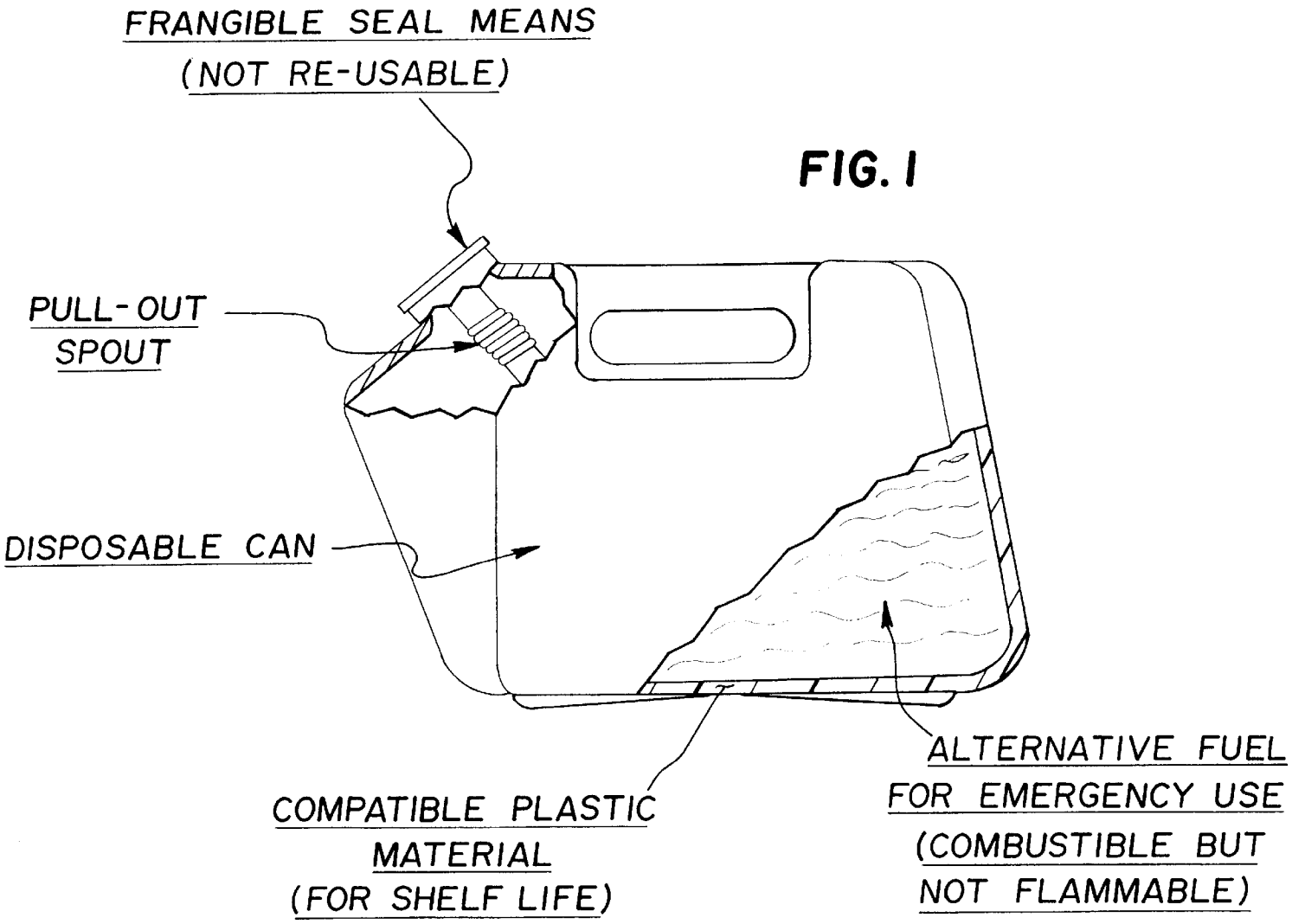
FIG. 1 is a partially cut-away side view of the present invention.
Figure 2:
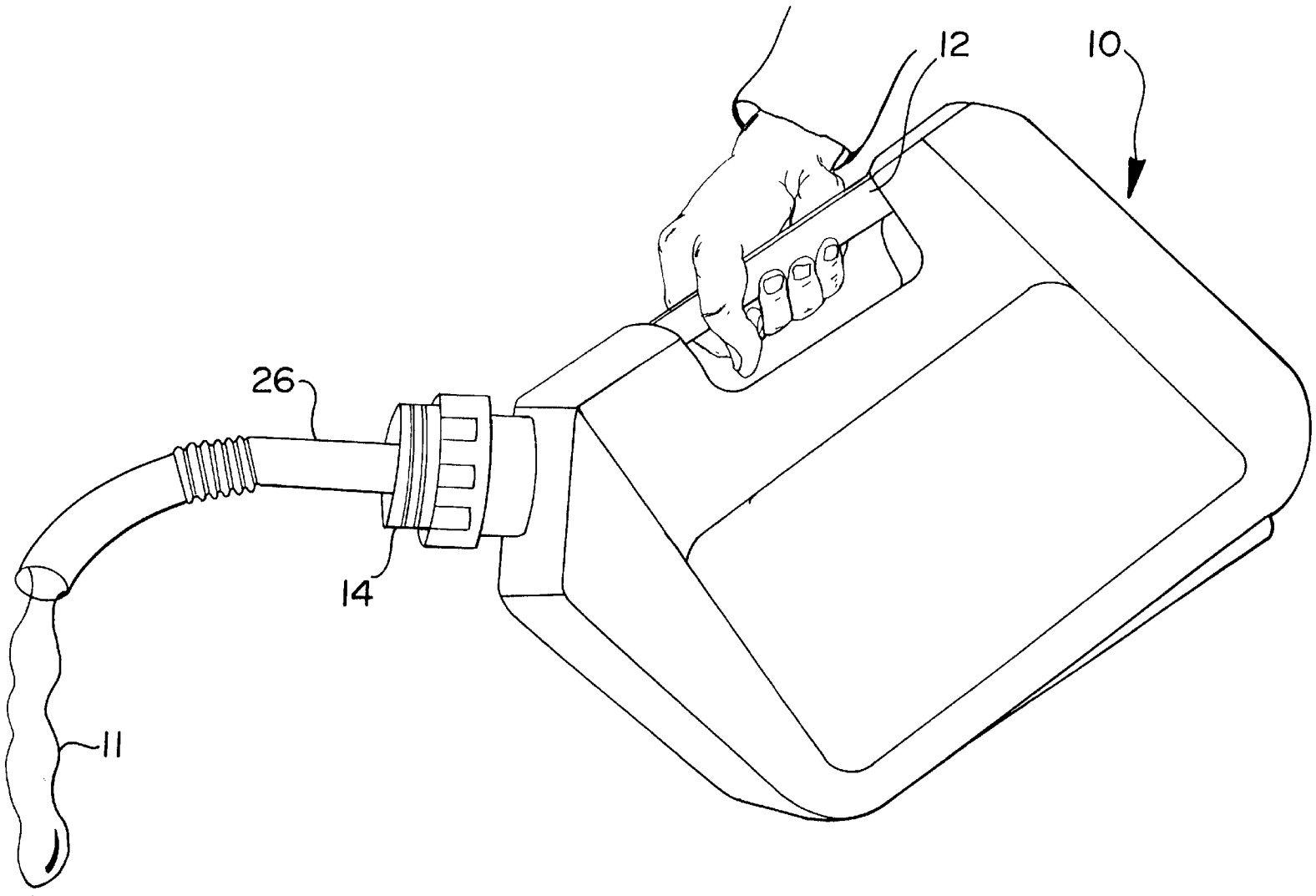
FIG. 2 is a perspective view of the container of the present invention being used to pour the emergency fuel.
Figure 3:
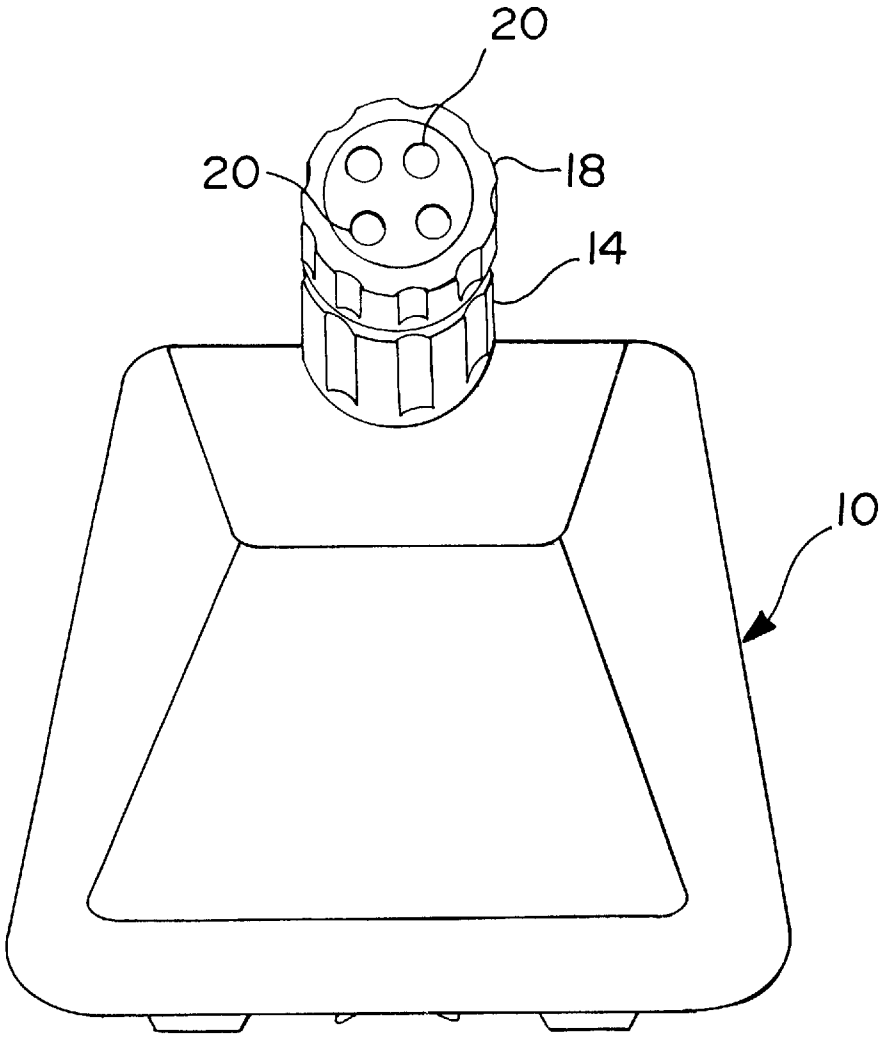
FIG. 3 is a front elevational view of the container showing the cap on the outlet.
Figure 4:
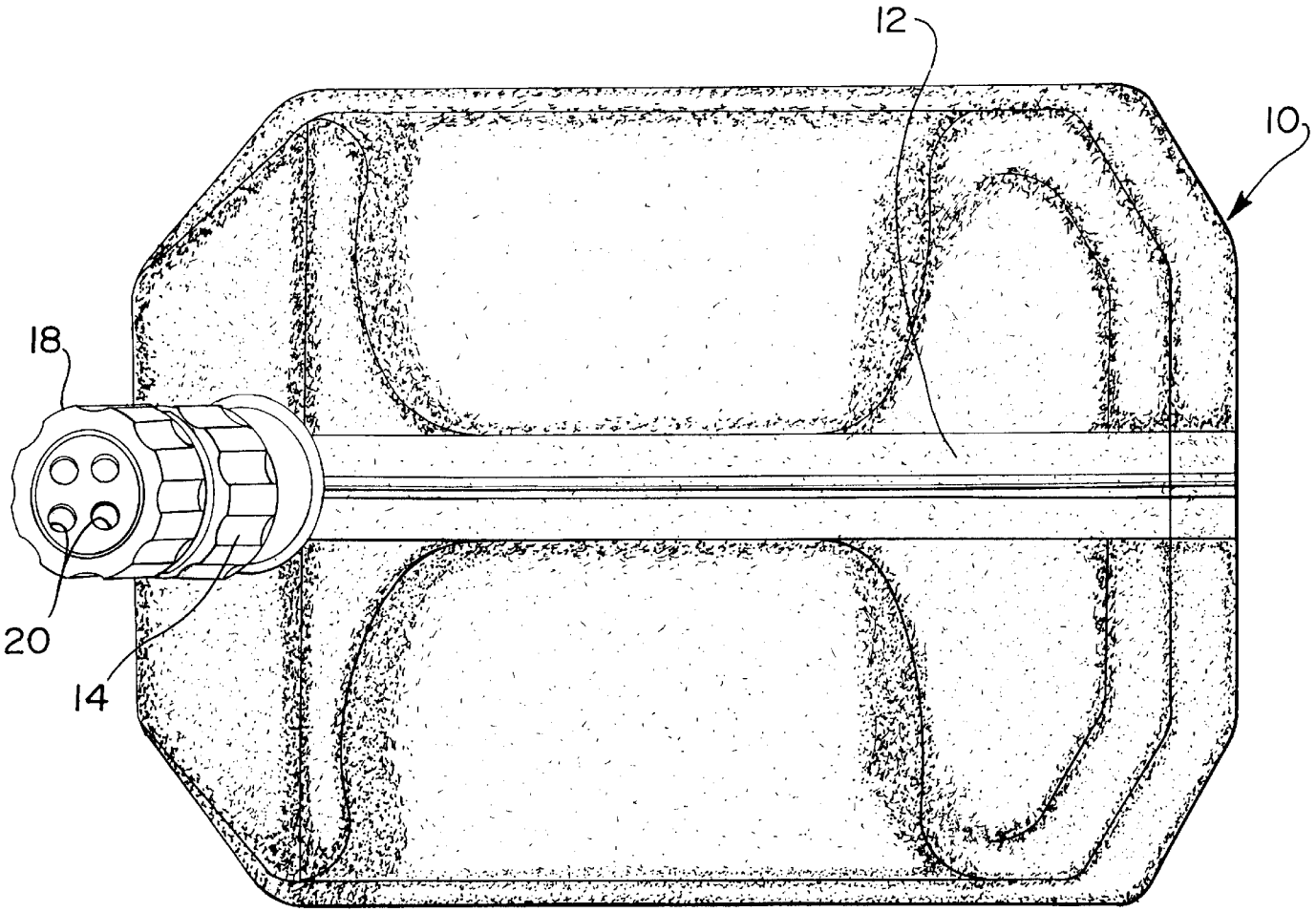
FIG. 4 is a top plan view of the container.
Figure 5:
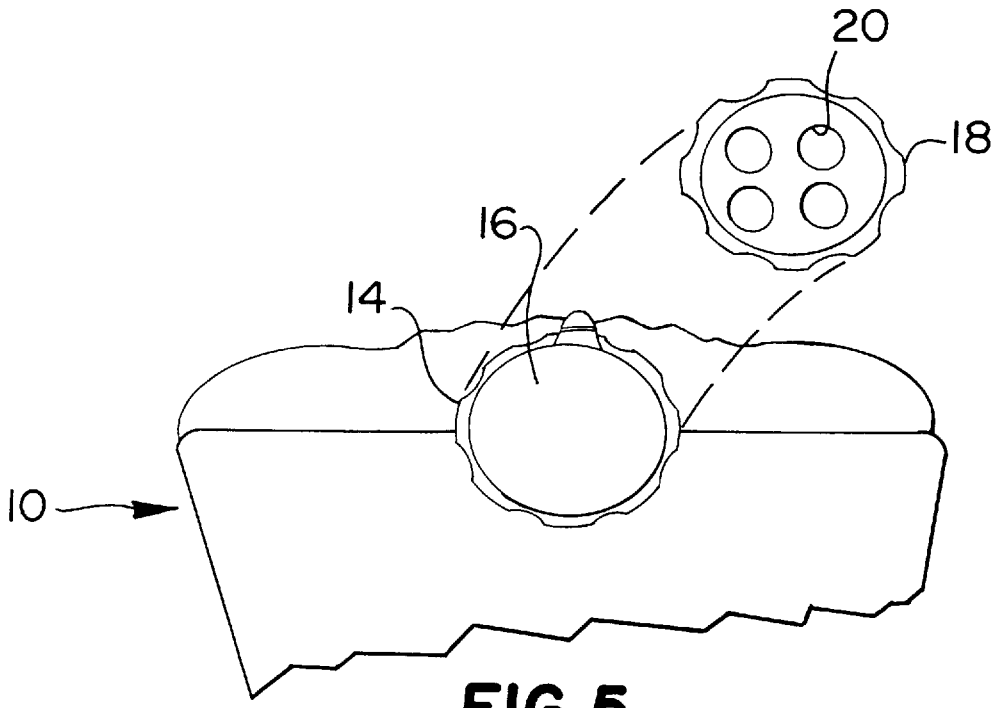
FIG. 5 is a perspective view showing the cap removed from the outlet to reveal the frangible seal.
Figure 6:
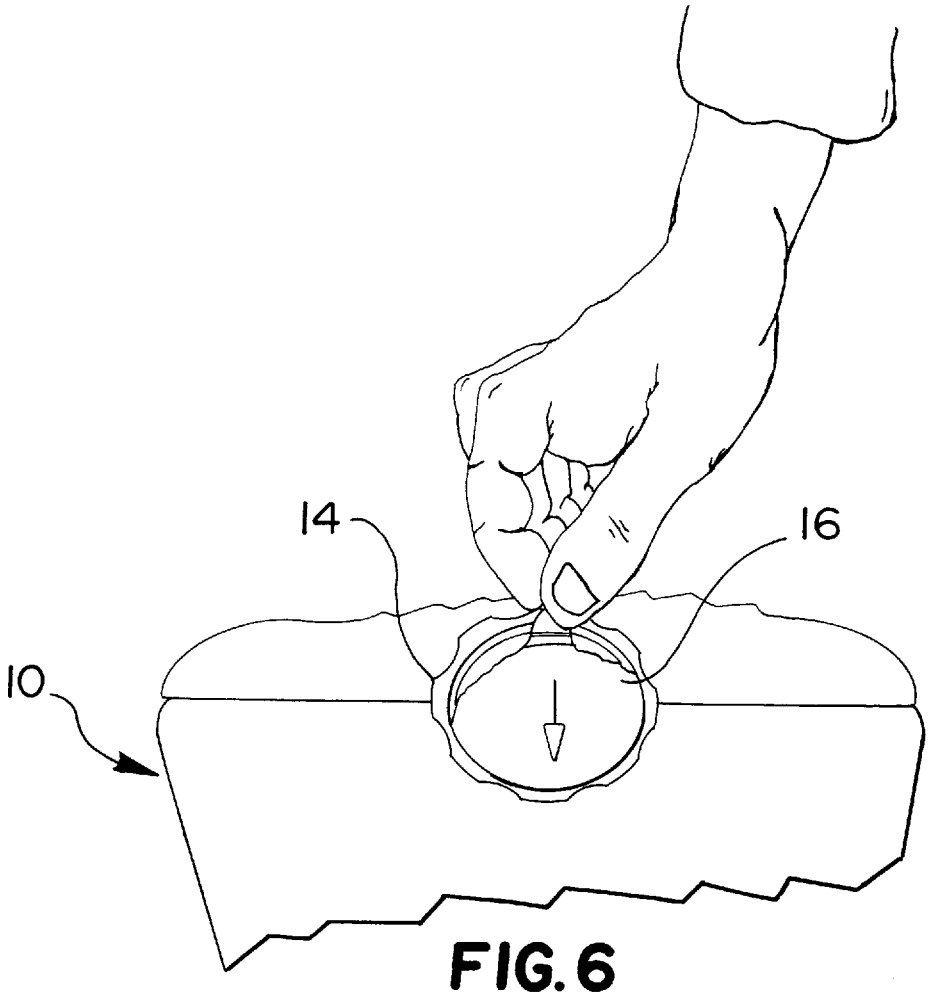
FIG. 6 is a perspective view showing removal of the frangible seal.
Figure 7:
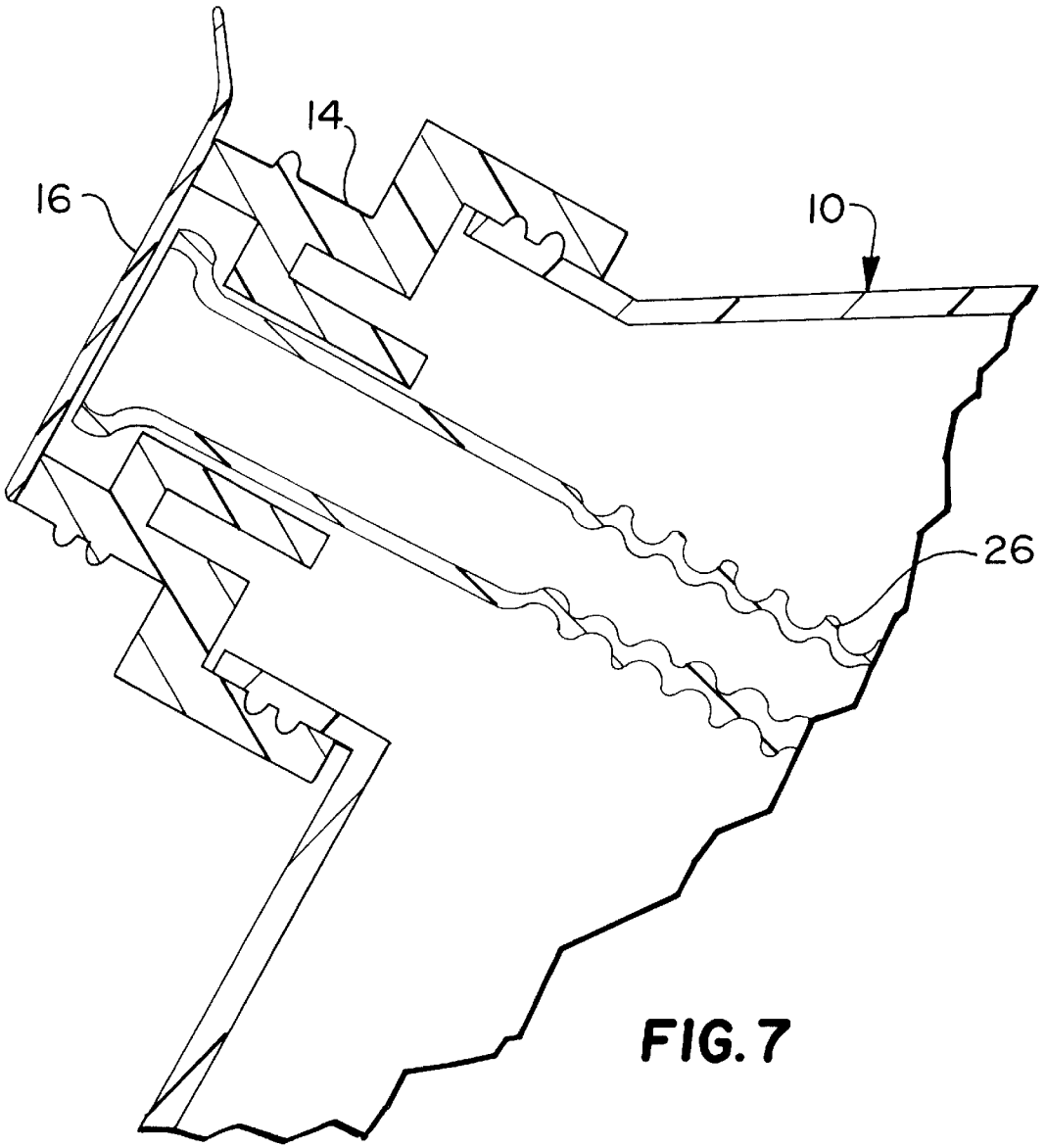
FIG. 7 is a cross-section view showing the frangible seal, the outlet on the extendable spout within the container.
Figure 8:
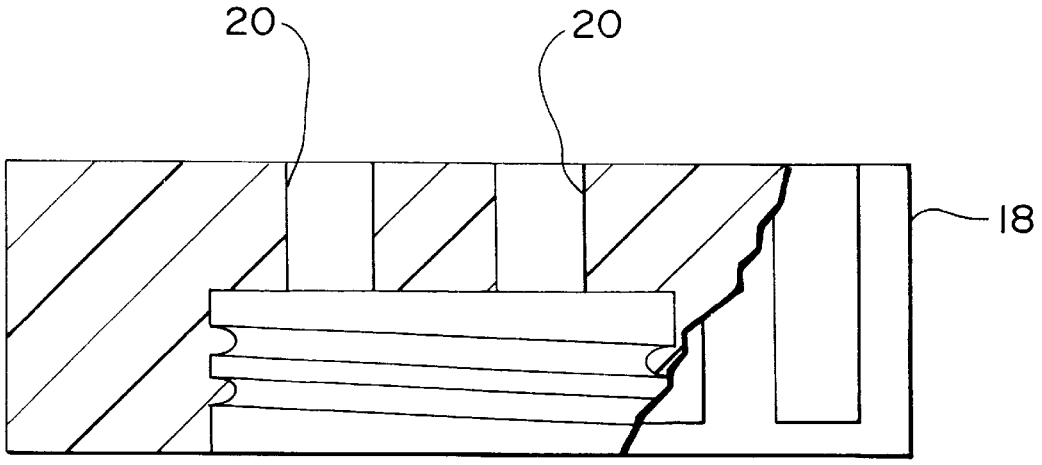
FIG. 8 is an enlarged cross-section view of the removable cap.

The emergency fuel disclosed herein solves the long-standing problem of how to safely guard against "running out of gas". A supply of said fuel can be safely stored in the vehicle and can be successfully used when the emergency arises.

The only choice under prior art was gasoline which is too dangerous to store in an automobile or other vehicle. This emergency fuel however, differs from gasoline in several respects. The components that make gasoline dangerous to store are the low boiling butanes, pentanes and similar lighter hydrocarbons. These are eliminated in the emergency fuel. At the same time, heavier components are balanced so that they are still within the gasoline boiling range and therefore will run well in an internal combustion engine.

One of the factors contributing to the safety of a fuel is the flash point of the fuel. For the optimum compromise of flash point versus safety and ease of starting, the preferred flash point is in the range of 104° to 110° F. This range gives a little margin of safety over the 100° F. limit, below which the U.S. Department of Transportation regulations classify a material as "flammable". If the flash point is above 100° F., the DOT permits the material to be reclassified as "combustible" and safety regulations are less stringent. A great many different refined mineral spirits, petroleum distillates and petrochemicals as well as oxygenated solvents and chemicals can be used if they fall within the desired flash point parameters and meet the other requirements. All flash points referred to herein are determined by ASTM D56, closed cup. Typical satisfactory mineral spirits are as follows:

| Mineral Spirit | A | B | C | D |
|---|---|---|---|---|
| Flash Point | 111° F. | 109° F. | 108° F. | 145° F. |
| Distillation Range | | | | |
| Initial Boiling Point | 324° F. | 324° F. | 320° F. | 372° F. |

-continued

| Mineral Spirit | A | B | C | D |
|---|---|---|---|---|
| 10% Recovered | 333 | 331 | — | 378 |
| 50% Recovered | 343 | 341 | — | 381 |
| 90% Recovered | 376 | 364 | — | 393 |
| Dry Point | 400 | 381 | 372° F. | 408° F. |
| Paraffins | 42% V | 40% V | 47% V | 45–55% V |
| Naphthenes | 52% V | 45% V | 53% V | 55–45% V |
| Aromatics | 8% V | 15% V | 0 | 0.25 |
| Olefins | 0 | 0 | 0 | 0 |
| Totals | 100% V | 100% V | 100% V | 100% V |

The paraffins, naphthenes and aromatics are hydrocarbons containing 9 to 12 carbon atoms in each molecule. Listed below are the oxygenated solvents which have been considered in connection with the formulation of the present invention.

| Material | Flash Pt. F | Evap. Rate | Boiling Pt. F |
|---|---|---|---|
| 1. Primary amyl alcohol (mixed isomers) | 113 | 0.20 | 261 |

An internal combustion engine operates well with amyl alcohol blended with mineral spirits. It does not generate a smelly, smoky exhaust and it will absorb water in the fuel system. The alcohol combines with the aromatics which are present in virtually all gasoline to form "co-solvents" which will attack the gums that form in a fuel system due to the use of gasoline. The cost of the blend with mineral spirits is reasonable. When 20% of this material is blended with a mineral spirits having a flash point of 145° F., the blend has a flash point of 113° F. It is stable in storage and sulfur free. It will not attack high density polyethylene (HDPE) containers.

| | | | |
|---|---|---|---|
| 2. 1-Pentanol | 119 | 0.18 | 280 |

This isomer of amyl alcohol could be used alone but would cost more than the blend listed in No. 1 above. When 25% of 1-pentanol is blended with 75% mineral spirits having a flash point of 108° F., to reduce cost, the blend has a flash point of 102° F.

| | | | |
|---|---|---|---|
| 3. 2-methyl butanol | 110 | 0.24 | 265 |

Works very well alone but is 50% more costly than 1-pentanol blended with mineral spirits. If blended with mineral spirits to reduce cost, the flash point drops too low, very close to 100° F.

| | | | |
|---|---|---|---|
| 4. n-butanol | 98 | 0.43 | 244 |

Flash point is below 100° F. Any blend with mineral spirits will lower it further. Works well when blended with mixed isomers of amyl alcohol and mineral spirits.

| | | | |
|---|---|---|---|
| 5. Amyl Acetate, primary (mixed isomers) | 101 | 0.20 | 295 |

Flash point is too close to 100° F. Also expensive. Will attack HDPE containers.

| | | | |
|---|---|---|---|
| 6. Cyclohexanone | 111 | 0.29 | 321 |

Runs well alone or blended with mineral spirits. 60% mineral spirits blended with 40% of this gives a flash point of 107° F. The blend will attack HDPE containers. Otherwise, the material is satisfactory.

| | | | |
|---|---|---|---|
| 7. Cyclohexanol | 154 | 0.05 | 321 |

Very low evaporation rate. Engine does not run well. Could be blended with mineral spirits to improve evaporation rate and cost but would still be expensive, and operation would be poor-running.

| | | | |
|---|---|---|---|
| 8. Diacetone alcohol | 133 | 0.12 | 363 |

It has a low evaporation rate and could be blended with mineral spirits to improve this. It is a ketone which would attack HDPE containers. Expensive.

| | | | |
|---|---|---|---|
| 9. Diisobutyl ketone | 140 | 0.19 | 336 |

Engine operation satisfactory when blended with mineral spirits. Expensive. Will attack HDPE containers.

| | | | |
|---|---|---|---|
| 10. Dimethyl formamide | 135 | 0.20 | 307 |

Expensive, approximately 50% more than 1-pentanol.

| | | | |
|---|---|---|---|
| 11. Ethyl butyl ketone | 115 | 0.43 | 298 |

Will attack HDPE. Only one supplier of a food grade material at a very high price.

| | | | |
|---|---|---|---|
| 12. Isobutyl isobutyrate | 101 | 0.47 | 297 |

Flash point too close to 100° F. Can form explosive peroxides during long term storage in contact with air.

| | | | |
|---|---|---|---|
| 13. Methyl n-amyl ketone | 102 | 0.33 | 303 |

Expensive. Flash point too close to 100° F. Attacks HDPE.

-continued

| Material | Flash Pt. F | Evap. Rate | Boiling Pt. F |
|---|---|---|---|
| 14. Methyl isobutyl carbinol | 103 | 0.27 | 269 |

Flash point too close to 100° F. Blend with mineral spirits would lower flash point below 100° F.

15. Others:
    A. A number of esters, such as hexyl acetate, pentyl propionate, butyl propionate and others, could be considered but are expensive and questionable with regard to peroxide formation.
    B. A number of derivatives of ethylene glycol and propylene glycol have the proper flash point and evaporation rate. However, all of these have a tendency to form dangerous peroxides and are ruled out for this reason.
    C. Derivatives of furan, such as furfuryl alcohol might possibly be used. However, these are all unsaturated molecules which are notoriously unstable in contact with air or else they are too expensive.
    D. A great number of more esoteric materials could be used but they would be expensive or might have other drawbacks. Some of these are as follows:
    propionic acid
    acetic acid
    formic acid
    various aliphatic amines
    dibutyl carbonate
    N-methyl ethylene diamine
    tributyl phosphine
    various aliphatic nitrates
    These might be used alone or in combination with mineral spirits or alcohols.

Many other solvents, chemicals and synthetic petrochemicals can be used if they meet all of the fuel requirements. Some of these include alkyl benzenes and alkylates obtained by reacting an isoparaffin with an olefinic paraffin. Also included would be oxygenated fuels such as methyl teriary butyl ether, tertiary amyl methyl ether as well as higher analogs and by products of these materials. Frequently, specific chemicals are produced by combining two or three materials. The desired end product may have a flash point less than is desired for this emergency fuel. However, after the desired end product is distilled overhead, the bottoms product may have a flash point that would make it useful as an emergency fuel.

The flash point of the emergency fuel is sufficiently high so that a burning match thrust into the fuel is extinguished and the fuel does not ignite. In order to run smoothly, the fuel must have an acceptable octane number so that knocking is not a problem. The minimum octane number should be in the range of 65 to 75. However, it is preferred that the octane number be 90 or greater to be comparable to premium grade gasoline. Mineral spirits without aromatics generally have an octane number of approximately 40 and do not provide satisfactory operation of the internal combustion engine. Inclusion of mineral spirits with higher aromatic content increases the octane number. If the fuel is disposed from a pump and if the octane number is 75 or greater, it is considered a gasoline for taxation purposes and becomes economically less desirable. However, if the fuel having an octane number of 75 or greater is sold only in a container, it is not considered to be taxable at the federal level and is economically viable. Blends of mineral spirits may be used to obtain a fuel with an acceptable octane number. The emergency fuel must also be within the gasoline distillation range with a distillation "end point" no higher than 450° F. A great many petroleum distillates such as certain mineral spirits or Stoddard solvents meet both requirements. The presence of naphthenes, aromatics and isoparaffins all help to improve the octane number. Normal paraffins decrease the octane number but these are not predominant except in "straight run" mineral spirits from crude oil that has never been cracked. Most mineral spirits are not in this category. On the other hand, a great many common chemicals and solvents such as cyclohexanone, ethyl butyl ketone and diacetone alcohol have acceptable octane ratings.

Another compositional difference from gasoline of the emergency fuel of the present invention, is the presence or absence of olefins. Gasolines normally contain olefins which contribute to gum formation and degrade the gasoline over extended time periods. The olefins are readily eliminated from hydrocarbons by hydrogenation. A number of hydrogen treated mineral spirits are available on the market. Their olefin content is substantially zero so they have excellent stability in long-term storage. Olefins can be tolerated in minimum amounts in the presence of alcohols and aromatics which combine to form "co-solvents" which will dissolve any gums formed from the olefins. Most synthetic petrochemicals are also essentially free of olefins. The hydrocarbons that are present in most olefin-free mineral spirits are quite stable and do not form unstable peroxides. The same is true of cyclohexanone and some of the other oxygenated solvents. On the other hand, certain chemicals, such as ethylene glycol monomethyl ether, may form unstable peroxides when stored in contact with oxygen. These unstable peroxides could decompose dangerously at the temperatures reached in an automobile trunk on a hot, sunny day.

The emergency fuel must also have a content of aromatic components low enough to prevent the production of soot and smoky combustion products so as to be clean. Excessive aromatics are deleterious to the internal combustion engine and are undesirable for consumer acceptance. It is preferred that aromatic content of the emergency fuel be less than 50% by volume.

It may be desirable to add an oxygenated solvent to the emergency fuel to produce a fuel that cleans the gum from the fuel system while performing its primary function. A number of oxygenated chemicals such as alcohols, esters, ketones and ethers can be used for this purpose as long as they don't:

a. Lower the flash point to an undesired level.
b. Interact with the container being used so as to damage the container or extract substances from the container to effect the usefulness of the emergency fuel.
c. Form unstable peroxides. A number of oxygenated chemicals should not be used because they are believed to form dangerously unstable peroxides during long periods of storage in contact with air. Some of these chemicals are as follows: isobutyl isobutyrate, ethyl 3-ethoxypropionate, propylene glycol monomethyl ether acetate, ethylene glycol monomethyl ether, propylene glycol mono tertiary butyl ether and others.
d. Present a carcinogenic risk, as in the case with benzene and other materials.

In some instances, the oxygenated solvent is useful as the emergency fuel in and of itself, without being mixed with mineral spirits. One such solvent is 1-pentanol and another is a blend of n-butanol with isomers of amyl alcohol.

Plastics such as high density polyethylene and polyethylene terephthallate or other plastics might be chosen as a material of construction for the container. The addition to the emergency fuel of aggressive solvents such as ketones or esters make it important to select a plastic and an oxygenated solvent which are compatible and do not interact. Metal containers could be used but they lack some of the advantages of plastic containers.

Referring now to FIGS. 1–8, the container 10 for storing the emergency fuel 11 preferably has a handle 12 for the user to carry the container and to hold while pouring. Preferably, the handle 12 is an integral portion of the container 10. The container 10 is formed with an outlet 14 from which the fuel 11 is poured. A removable seal 16 is disposed over the opening of the outlet 14 to retain the fuel 11 in the container 10, prevent evaporation of the fuel 11 and provide evidence of tampering. In one embodiment, the seal 16 is a frangible layer, such as foil which is secured around the circumference of the outlet 14 by adhesive, ultrasonic sealing or other means. The outlet 14 further has an outwardly extending neck which is threaded. A cap 18 having cooperating threads is disposed on the end of the outlet 14 such that the frangible seal 16 is between the cap 18 and the outlet 14 and the seal 16 is protected from accidental damage or rupture. The cap 18 has at least one opening 20 formed through the upper surface of the cap 18. The opening 20 is of a size so that the seal 16 is protected from damage but is large enough so that liquid and vapor pass through the opening 20. The purpose of the cap 18 having at least one opening 20 is to prevent or discourage reuse of the containers 10 for storage of fuel such as gasoline or other flammable materials after removal of the seal 16 and use of the emergency fuel 11. Without such a closure, some consumers would open said container, use the emergency fuel, then refill said container with gasoline and store it for future use. This could be very dangerous.

Figure 9:
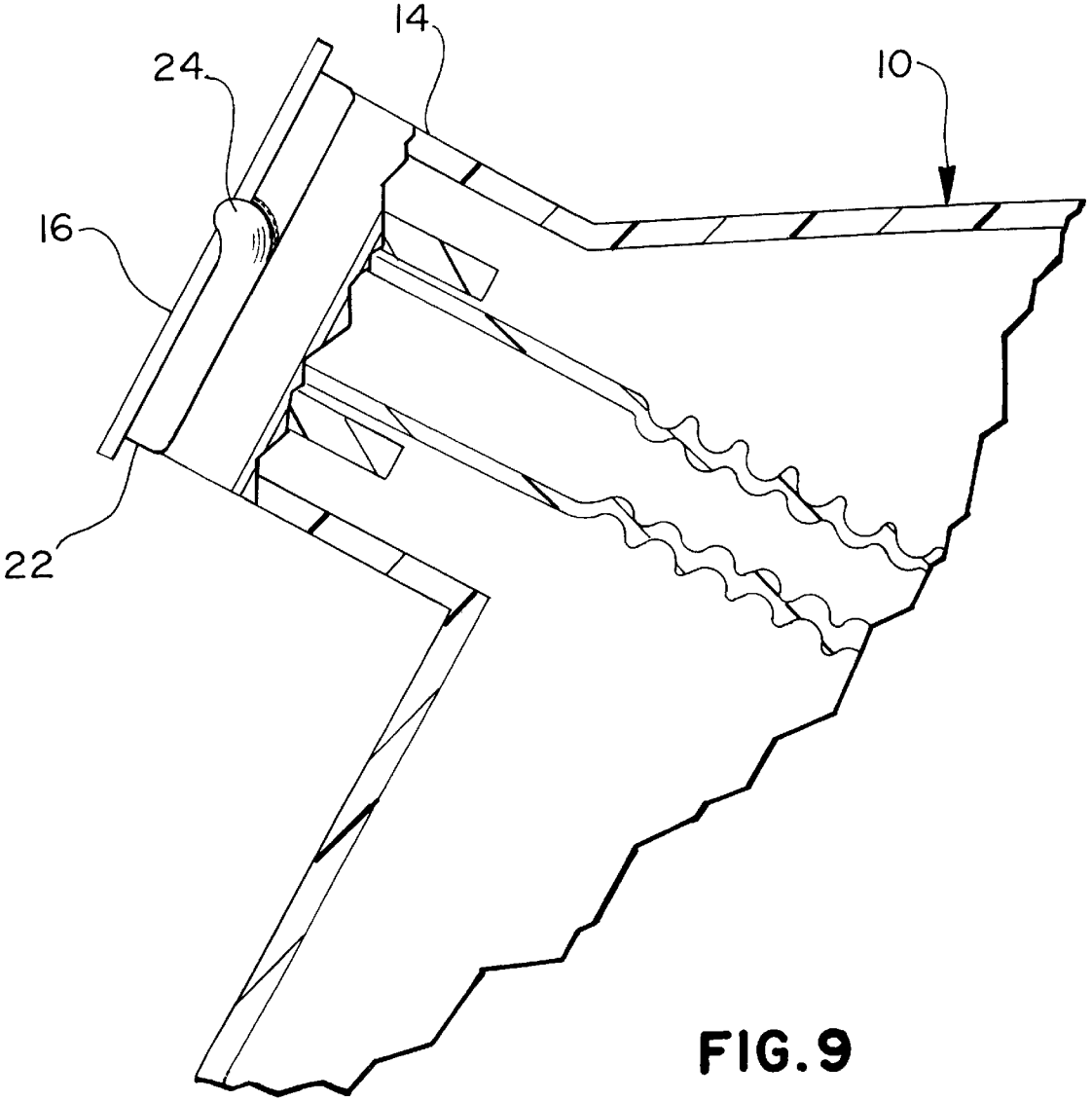
FIG. 9 is a perspective view of an alternate embodiment of a removable seal.

In another preferred embodiment (FIG. 9), the seal 16 is a cover over the outlet 14 with a band 22 integrally attached to the cover, the band extending completely around the outlet and retaining the seal 16 on the outlet 14. The band 22 is formed with a pull tab 24. Pulling the pull tab 24 separates the band 22 from the cover and permits removal of the cover to gain access to the emergency fuel. When the cover and the band 22 are secured to the outlet 14, the emergency fuel 11 is retained within the container 10 for a storage period of at least one (1) year. After the seal 16 is removed, the cover cannot be reattached to the outlet so that the container 10 cannot be reused for storage of gasoline and similar fuels.

Figure 10:
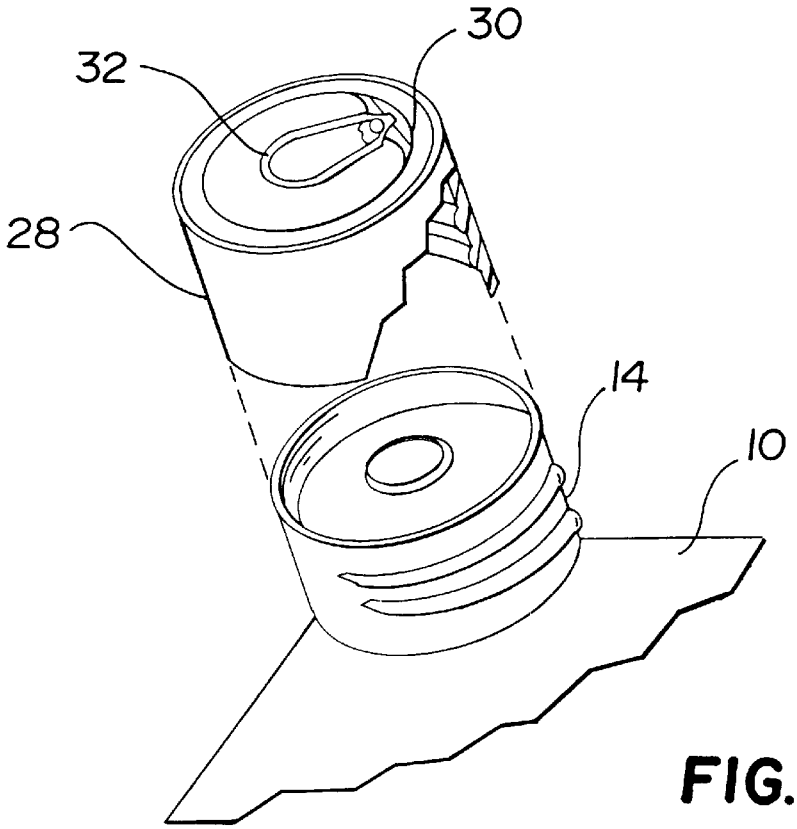
FIG. 10 is a perspective view of an alternate embodiment of the removable seal.
Figure 11:
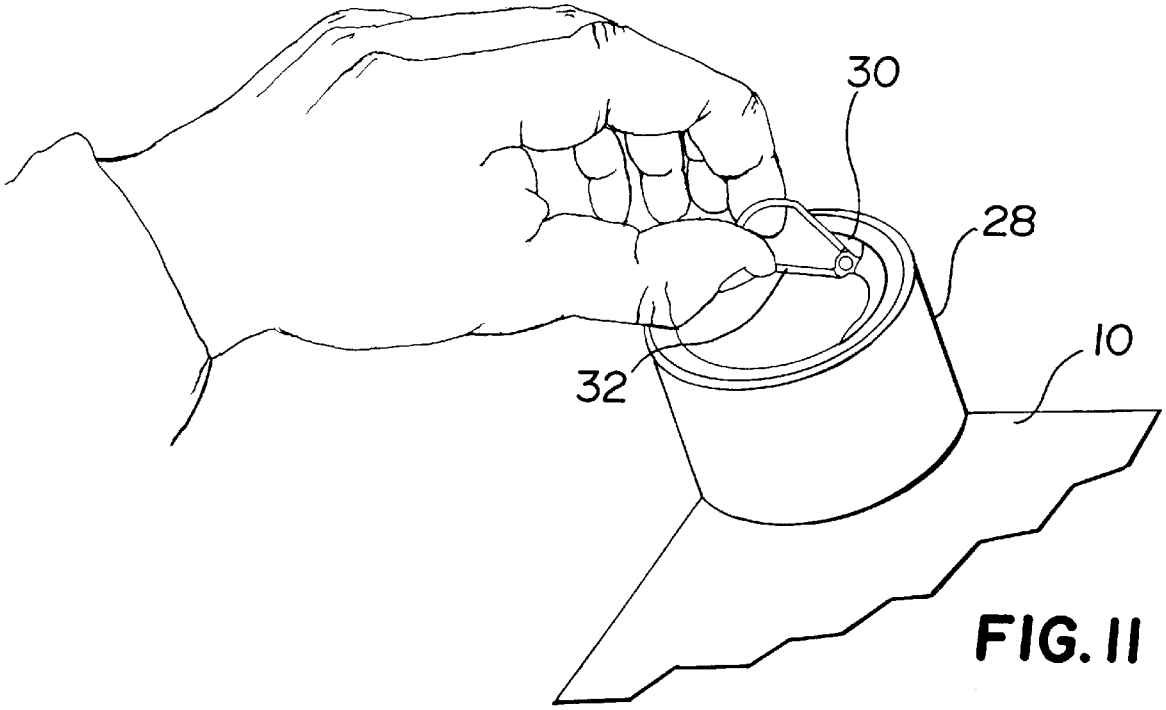
FIG. 11 is a perspective view showing grasping of the pull ring of the removable seal of FIG. 10.
Figure 12:
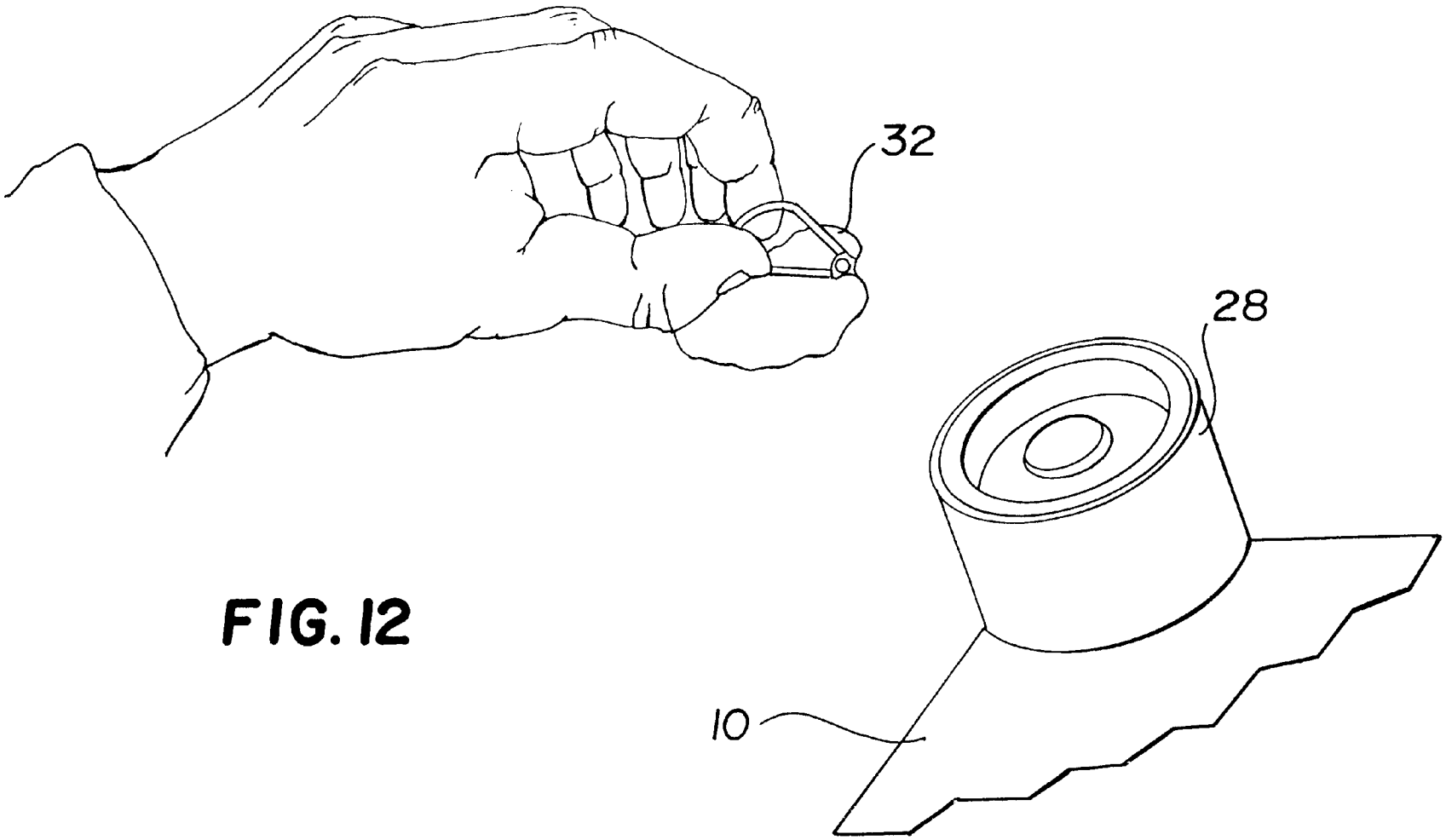
FIG. 12 is a perspective view showing removal of a portion of the cap of the removable seal of FIG. 10.

In yet another preferred embodiment as shown in FIGS. 10–12, the seal 16 is a threaded cap 28 having threads which cooperate with threads on the outlet 14. The top of the cap 28 has a prestressed ridge 30 formed therein. The prestressed ridge 30 may be around the circumference of the cap or may define a more limited area of the top of the cap 28. Within the area circumscribed by the prestressed ridge 30, a pull ring 32 is attached to the top of the cap 28. Thus, the cap 28 closes and seals the outlet 14 of the container 10 when the container 10 with the emergency fuel 11 therein is stored for a period of at least one year. When access to the emergency fuel 11 is required, a user grasps the pull ring 32 and pulls away from the cap 28. The entire area of the cap 28 attached to the pull ring 32 within the area circumscribed by the prestressed ridge 30 is separated from the cap 28 leaving an opening in the cap 28. The opening has a diameter large enough to permit the spout 26 to be extended therethrough and the emergency fuel may be poured from the container 10. The container with the opening in the cap 28 is no longer useful for storage of fuel and the container 10 is disposable and expendable.

Other types of removable seals may be used as long as the seal retains the alternate fuel in the container when stored for at least one year, the seal is made of material compatible with the emergency fuel and the seal cannot be used to close the container to permit reuse of the container.

The container 10 also has a spout means 26 to facilitate pouring the emergency fuel 11 from the container 10. This obviates the need for a long-neck funnel with which to pour said emergency fuel into the fuel tank. Such funnels are hard to find and a nuisance to store. In an emergency situation, it is unlikely that a long-neck funnel would be available. The container 10 may have an integrally formed spout means 26 with the outlet 14 distal from the body of the container. In a preferred embodiment the spout means 26 is a separate member which is retained within the container 10 and is extended outwardly from the outlet 14 after the seal 16 is removed. The spout means 26 has sufficient length to press open the metal shield in the inlet to an automobile gas tank and the diameter of the spout means 26 is small enough to fit into the lead-free gas tank inlet.

The container 10 is provided in any desired size. A capacity of one (1) quart is useful for motorcycles and similar vehicles, a one (1) gallon for typical passenger automobiles and five (5) gallons for trucks and boats.

In small motor boats and motorcycles, the emergency fuel will start most warm motors and run smoothly in them. Such motors are almost always warm when they run out of gas and the emergency fuel will usually start them if used promptly. In cases where the motor has cooled down and doesn't start, it may be necessary to use a "starter fluid" such as a butane spray in the carburetor to make the motor start. This works well with the emergency fuel. Even if a starter fluid is required, it is fairly easy to utilize with small motors.

Automobiles are a different matter, especially with the widely-used fuel-injection systems. However, there is an unexpected and surprising result in the case of automobiles. When an automobile "runs out of gas" and the motor dies, there is still a residual amount of a gallon or more of gasoline remaining in the tank and in the fuel system. When the emergency fuel is added, it mixes with this remaining gasoline which provides enough of the butanes and pentanes to start even a cold motor.

The emergency fuel cannot be used to replace gasoline on a long term basis because it lacks the butanes and pentanes needed for cold starts under normal conditions. For emergency use on a short term basis, the emergency fuel is quite satisfactory.

To illustrate the manner in which the invention may be carried out, the following examples are given. It is to be understood, however, that the examples are for the purpose of illustration and the invention is not to be regarded as limited to any of the specific materials or conditions recited therein. Unless otherwise indicated, parts described in the examples are parts by volume.

EXAMPLE I

This example illustrates the use alone of a mineral spirits type of petroleum distillate. This material had an ASTM D56 flash point ranging from 105° F.–115° F., an ASTM D86 distillation range of approximately 320° F. to 405° F. with a dry point of approximately 415° F. or less. The composition was approximately by volume, at least 40% paraffins, 45% naphthenes and up to 15% aromatics. Olefin content was nil. The cold test motor failed to start with this material but after the test motor was warmed up, it started readily and ran smoothly using said material.

EXAMPLE II

This example illustrates the use of a blend of a mineral spirits with an oxygenated solvent. The mineral spirits had a flash point of 106° F. and a boiling range of 319° F. to 383° F. The oxygenated solvent was methyl isobutyl carbinol having a flash point of 103° F. and a boiling point of 269° F. A blend of the two materials was made using 60% of said mineral spirits and 40% of said carbinol. Said blend of the two materials had a flash point of 94° F. The olefin content was nil. The cold test motor failed to start with said blend, but after the test motor was warmed up, it started readily and ran smoothly using said blend. Said blend exerted some visible cleaning action in the gas tank as it removed some of the gum deposits.

EXAMPLE III

This example illustrates the use of a blend of a mineral spirits with a ketone. The mineral spirits had a flash point of 109° F. and a distillation range of 324° F. to 381° F. The ketone was cyclohexanone with a flash point of 116° F. and a boiling point of 312° F. The blend was made by using a 50/50 mix of said mineral spirits and said ketone. The blend had a flash point of 109° F. and the olefin content was nil. The cold test motor failed to start using the blend but after the test motor was warmed up, it started readily and ran smoothly using said blend. Said blend exerted a strong cleaning effect as it removed gum deposits.

EXAMPLE IV

This example illustrates the emergency fuel being only an oxygenated solvent. n-Butanol has a flash point of 98° F. and mixed isomers of amyl alcohol has a flash point of 113° F. A blend of 50% n-butanol with 50% of the mixed isomers of amyl alcohol gives a flash point of 104° F. which is classified as a "combustible" substance. This blend operates better than any other blend because of the more volatile n-butanol, but the cost is greater. It will not attack the HDPE container and is stable in storage. It improves the exhaust quality as compared to any blend with mineral spirits because of is greater oxygen content. This blend failed to start the cold test motor but after the motor was warmed up, it started readily and ran smoothly.

EXAMPLE V

This example illustrates the use of a single alcohol, the mixed isomers of amyl alcohol. This material has a flash point of 113° F. Said material failed to start the cold test motor but after the motor was warmed up, it started readily and ran smoothly.

EXAMPLE VI

This example illustrates the use alone of a mineral spirits having a flash point of 108° F. The boiling range was from 320° F. to 372° F. The composition was as follows:

| | |
|---|---|
| Paraffins | 46.6% |
| Naphthenes | 53.3% |

It must not contain any olefins which can form gums during storage. Without any alcohols, the mineral spirits will not act as a solvent to remove gums from the fuel system. Said mineral spirits failed to start the cold test motor but after the motor was warmed up it started readily and ran smoothly.

EXAMPLE VII

This example illustrates the use of a blend of 75% of the mineral spirits described above in Example VI with 25% of the mixed isomers of amyl alcohol. This blend has a flash point of 102° F. Said blend failed to start the cold test motor but after the motor was warmed up, it started readily and ran smoothly.

EXAMPLE VIII

This example illustrates the use of a blend of 75% of the mineral spirits described above in Example VI with 25% of cyclohexanone having a flash point of 111° F. and a boiling point of 314° F. The blend has a flash point of 101° F. Said blend failed to start the cold test motor but after the motor was warmed up, it started and ran smoothly.

EXAMPLE IX

This example illustrates the use of mineral spirits which contain some olefins and which are blended with alcohols. Olefins are a potential problem in materials which face long term storage, because they oxidize to form gums which foul up the fuel system. However, the blend of this example contains alcohols which act as solvents for any gums that form so the gums will not precipitate out and foul the fuel system. For best long-term storage, the olefin content should be minimized, even if alcohols or other oxygenated solvents are present. The olefin content in the final blend should not exceed 50% and preferably, is less than 5%. In this example, the mineral spirits used has the following characteristics:

| | |
|---|---|
| Flash point | 125° F. |
| Initial boiling point | 346° F. |
| Dry point | 390° F. |
| Composition: | |
| Aliphatic hydrocarbons | 96% |
| Olefins | 4% |
| Aromatics | — |
| Total | 100% |

The following blend was prepared:

| | |
|---|---|
| Mineral spirits | 65% |
| n-butanol | 5% |
| amyl alcohol, mixed isomers | 30% |
| Total | 100% |

Said blend had a flash point of 104° F. Said blend failed to start the cold test motor but after the motor was warmed up, it started readily and ran smoothly.

EXAMPLE X

This example illustrates the use of approximately 80% mineral spirits with approximately 20% primary amyl alcohol-mixed isomers. The mineral spirits sold as SOL 142 HT by the Shell Chemical Company is satisfactory. This material has the following properties:

| | |
|---|---|
| Specific Gravity @ 60/60° F. | 0.7775–0.8035 |
| API | 44.6–50.5 |
| Color, Saybolt | 25 min. |
| Appearance | Clear |
| Distillation: | |
| Initial BP, ° F. | 350 min. |
| 10% | 378 |
| 50% | 381 |
| 90% | 393 |
| Dry Point, ° F. | 415 max. |
| Aniline Clear Point | 165 max. |
| Kauri Butanol Value | 29 min. |
| Flash Point TTC, ° F. | 142 min. |

Satisfactory primary amyl alcohol sold by Union Carbide has the following properties:

| | |
|---|---|
| Total amyl alcohols | 98.0% by weight, minimum |
| n-Amyl alcohol | 50 to 70% by weight |
| 3-Methylbutanol | 0.10% by weight, maximum |
| Acidity | 0.01% by weight, maximum calculated as acetic acid |
| Aldehydes | 0.20% by weight, maximum as C-5 aldehydes |
| Water | 0.20% by weight, maximum |
| Color | 15 platinum-cobalt, maximum |
| Suspended matter | substantially free |
| Specific gravity, at 20/20° C. | 0.812 to 0.819 |
| Distillation, 760 mm | Ibp 261° F., minimum; Dp 282° F., maximum |

This blend failed to start the cold test motor but, after the motor was warmed up, it started and ran smoothly. The motor operates satisfactorily with alcohol concentrations, ranging from 0°–30%. As previously noted, the presence of the amyl alcohol, along with the aromatics found in virtually all gasolines results in a fuel which is effective in dissolving gum residue from the fuel system of the engine.

EXAMPLE XI

This example shows a mineral spirit fuel to which a biocide has been added to prevent the growth of fungus and bacteria in the stored fuel. A biocide sold by Angus Chemical Co., Buffalo Grove, Ill. 60089 under the trademark "FUEL SAVER" has been found to be effective but other biocides may be used. The biocide must be combustible and must not be deleterious to the internal combustion engine, the catalytic catalyst in the exhaust of the engine nor the container in which the emergency fuel is stored. The biocide is present in the fuel in the range of 135 to 500 ppm and a preferred concentration is 300 ppm.

EXAMPLE XII

This example is a mixture of mineral spirits to obtain an emergency fuel with an octane number between 65 and 75 and preferably, an octane number of 70. If the octane number is below 65, efficient operation of the internal combustion engine is not obtained. The following blend has been found to be effective:

| | Mineral Spirits 200 HT* | Mineral Spirits Cyclosol 100* |
|---|---|---|
| Volume % | Approx. 73 | Approx. 27 |
| Flash point | 111° F. | 111° F. |
| Initial Boiling Point | 324° F. | 320° F. |
| 50% recovered | 343° F. | 329° F. |
| dry point | 372° F. | 348° F. |
| Olefins % | 0 | 0 |
| Aromatics % | 0 | 100 |

*Product names of mineral spirits marketed by Shell Chemical Co., Houston, TX 77027.

This mixture has an octane number of 70. Other blends of mineral spirit fractions each having differing aromatic content from the above-identified fractions may be used and the present invention is not limited to the example disclosed herein. The above example is for illustration purposes only. The flash point exceeding 100° F. and the octane number of approximately 65–75 are obtained with the above mineral spirit mix. It is suggested that a biocide (135–500 ppm) be added to the fuel to prevent the growth of bacteria and fungi in the fuel.

EXAMPLE XIII

This example is to provide an emergency fuel with an octane number of 90 or higher to more closely emulate premium grade gasoline and provide more efficient operation of the engine. The following blend produced this quality fuel:

Mineral Spirits 200 HT approximately 58%

Mineral Spirits Cyclo Sol 100 approximately 42%

A preferred blend of 57% 200 HT and 43% Cyclo Sol 100 has an octane number of 92. The aromatic content is similar to that of premium grade gasoline. The blend operates in virtually any engine without "pinging". It is also preferred that the biocide "FUEL SAVER" be present at a concentration of 135 to 500 ppm and preferably at a concentration of 300 ppm. This blend has a flash point of 110° F. and boiling point of approximately 320° F. The cost is comparable to other blends.

Octane numbers between 70 and 100 can be obtained, if desired, by varying the percentage of mineral spirits consisting of 100% aromatic components. The following relationship exists for Cyclo Sol 100:

| Octane Number | % CS 100 in blend |
|---|---|
| 70 | 27 |
| 75 | 30.8 |
| 80 | 34.5 |
| 85 | 38.3 |
| 90 | 42.1 |
| 92 | 43 |
| 95 | 46 |
| 100 | 50 |

As the aromatic content increases, the exhaust from the engine tends to more black and to have a disagreeable odor. Thus, aromatic content preferably, is limited.

Although the emergency fuels in the above examples did not start the cold test motor, the emergency fuel does start an engine which has a residual volume of gasoline in the fuel tank. As previously noted, the emergency fuel has no butane or pentane, but the residual gasoline has sufficient quantities of these materials, with a low flash point, to permit starting of the engine. After the engine has started it will continue to operate using the emergency fuel of the present invention.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. An emergency fuel for an internal combustion engine to be stored in a vehicle and to be used when the vehicle is out of fuel, the emergency fuel comprising:

mineral spirits, the emergency fuel having an octane number of at least 90, and wherein the mineral spirits is a mixture of approximately 58–50% by weight of a first fraction having 0% aromatic content and approximately 42–50% by weight of a second fraction having 100% aromatic content.

2. The emergency fuel of claim 1, wherein the first fraction is 57% by weight and the second fraction is 43% by weight.

3. An emergency fuel for an internal combustion engine to be stored in a vehicle and to be used when the vehicle is out of fuel, the emergency fuel comprising:

mineral spirits, a biocide in the range of 135–500 ppm, and the emergency fuel having an octane number of at least 70.

4. An emergency fuel for an internal combustion engine to be stored in a vehicle and to be used when the vehicle is out of fuel, the emergency fuel comprising:

mineral spirits, the emergency fuel having an octane number of at least 70, and the emergency fuel having a flash point of at least 100° F.

5. The emergency fuel of claim 4, wherein the mineral spirits has a boiling point of approximately 320° F.

6. The emergency fuel of claim 4, further comprising a biocide in the range of 135–500 ppm.

7. The emergency fuel of claim 6, wherein the biocide is present as 300 ppm.

* * * * *